US005687917A

United States Patent [19]

Law et al.

[11] Patent Number: 5,687,917

[45] Date of Patent: Nov. 18, 1997

[54] HIGH CONSISTENCY PULP REFINING USING LOW CONSISTENCY PULP REFINING TECHNIQUES

[75] Inventors: Kim Shing Law, Vancouver; Suezone Chow, Richmond, both of Canada

[73] Assignee: Canadian Forest Products Ltd., Canada

[21] Appl. No.: 583,570

[22] Filed: Jan. 5, 1996

[51] Int. Cl.[6] ..... B02C 7/02; B02C 7/12

[52] U.S. Cl. ..... 241/21; 241/24.11; 241/28; 241/261.3

[58] Field of Search ..... 241/28, 261.2, 241/261.3, 21, 20, 24.11

[56] References Cited

U.S. PATENT DOCUMENTS

| | | | |
|---|---|---|---|
| 2,801,084 | 7/1957 | Krupp et al. | 241/261.2 X |
| 3,214,104 | 10/1965 | Breuninger et al. | 241/261.2 X |
| 4,372,495 | 2/1983 | Marton et al. | 241/28 |
| 4,555,064 | 11/1985 | Asano et al. | 241/89.3 |
| 4,819,881 | 4/1989 | Sepke | 241/88.1 |
| 5,531,385 | 7/1996 | Witsken | 241/21 |

OTHER PUBLICATIONS

Chapter 13 (pp. 194–208) from "Handbook for Pulp & Paper Technologists", 2nd Edition, by G.A. Smook, published by Angus Wilde Publications, Copyright 1992 by G.A. Smook.

*Primary Examiner*—John M. Husar

*Attorney, Agent, or Firm*—Knobbe Martens Olson & Bear LLP

[57] ABSTRACT

A refiner-apparatus and method for producing refined pulp by exerting mechanical forces on pulp fibres. The apparatus includes a member having a pulp side and a drainage side, the pulp side having a plurality of spaced apart raised bar portions thereon. A plurality of drainage conduits are formed in the member, the conduits extending between the pulp side and the drainage side of the member, each drainage conduit having inlet and outlet openings respectively. The inlet openings are disposed on the pulp side of the member and the outlet openings are disposed on the drainage side of the member such that water expelled from pulp fibres forced against the pulp side is received in the inlet openings and is conducted through the drainage conduits to the drainage side of the member. Generally, the method involves draining water from pulp fibres squeezed between facing refiner members, through at least one drainage conduit in at least one of the refiner members. Use of the method produces a low consistency pulp solution of refined pulp having properties comparable to high consistency refined pulp.

28 Claims, 3 Drawing Sheets

HIGH CONSISTENCY PULP REFINING USING LOW CONSISTENCY PULP REFINING TECHNIQUES

RELATED APPLICATION

The present application claims the benefit of priority under 35 U.S.C. §119 (e) of Provisional application Ser. No. 60/007,075, filed Oct. 25, 1995.

BACKGROUND OF THE INVENTION

This invention relates to pulp refining apparatus and methods, and more particularly to an apparatus and method of employing generally low consistency pulp refining apparatus to produce pulp having properties comparable to pulp produced using high consistency refining techniques.

High consistency pulp refining is used to produce high strength paper such as is typically used in cement sacks and grocery bags. High consistency pulp however, is difficult to handle in that special pumping methods and other specially adapted equipment must be used to cause the pulp to flow through conduits of the refining system and to facilitate refining. The use of such specialized equipment requires a considerable investment in equipment which generally can only be used for one purpose—namely high consistency refining.

Low consistency pulp refining is much easier and less costly to do as conventional pump technology and relatively non-specialized equipment may be used to propel the pulp through conduits of the system and to effect refining. However, refined low consistency pulp does not have the same strength characteristics as high consistency pulp and therefore cannot be used in applications such as cement sacks and grocery bags.

Careful investigation of the process of refining has revealed that high consistency refining is achieved where there is a relatively high concentration of pulp fibres in a refining zone between oppositely facing refiner bars of either a conical or plate refiner. With high consistency pulp refining equipment, this high concentration of pulp is achieved due to the high concentration of pulp fibres in the pulp solution entering the refiner. As stated above, this requires specialized equipment.

What is desired therefore is a way of producing a low consistency refined pulp solution wherein the pulp has a strength comparable to that produced by high consistency refining methods, from a low consistency pulp solution. This is addressed by the present invention.

SUMMARY OF THE INVENTION

In accordance with one aspect of the invention, there is provided a refiner apparatus for exerting mechanical forces on pulp fibres. The apparatus includes a member having a pulp side and a drainage side, the pulp side having a plurality of spaced apart raised bar portions thereon. A plurality of drainage conduits are formed in the member, the conduits extending between the pulp side and the drainage side of the member, each drainage conduit having inlet and outlet openings respectively. The inlet openings are disposed on the pulp side of the member and the outlet openings are disposed on the drainage side of the member such that water expelled from pulp fibres forced against the pulp side is received in the inlet openings and is conducted through the drainage conduits to the drainage side of the member.

Preferably, each of the inlet openings has a diameter of approximately one-half of the average pulp fibre length of the pulp intended to be processed by the refiner apparatus and each of the inlet openings is spaced apart from an adjacent opening by a distance greater than the average pulp fibre length intended to be processed by the refiner apparatus.

Preferably, each of the drainage conduits has a length generally equal to the diameter of its corresponding inlet opening.

The member may include a generally disk-shaped plate operable to be rotated in a disk refiner, the drainage side being separated from the pulp side by the disk-shaped plate. Preferably, the disk-shaped plate has a drainage surface on the drainage side and a plurality of spacers for spacing the drainage surface from a mounting surface associated with the disk refiner such that water flowing from the outlet openings is operable to flow radially of the disk-shaped plate, between the drainage surface and the mounting surface for collection at an exhaust port of the disk refiner.

Preferably, the spacers include a plurality of generally radially extending wall portions projecting from and disposed on the drainage surface, the radially extending wall portions being operable to direct water to flow radially outwardly from the outlet openings when the disk-shaped plate is rotated.

The plate may have a plurality of collection conduits, each of the collection conduits being in communication with a plurality of outlet openings and being operable to channel water from respective outlet openings of the drainage conduits to the drainage side of the disk-shaped plate. Preferably, approximately seven outlet openings are in communication with one respective collection conduit.

In accordance with another aspect of the invention, there is provided an apparatus for refining pulp, the apparatus including first and second sets of facing refiner bars having opposing pulp sides, at least one of the sets being moveable relative to the other, and the first and second sets being positioned relative to each other such that mechanical pressure is applied to pulp fibres between opposing pulp sides of the refiner bars when the at least one of the sets is rotated. At least one of the sets of refiner bars has a drainage side separated from the pulp face side and has a plurality of drainage conduits for draining water from pulp fibres between the opposing face sides of the refiner bars.

Preferably, each of the drainage conduits has inlet and outlet openings respectively, the inlet openings being disposed on the pulp face sides of the bars of one of the sets and the outlet openings are disposed on the drainage sides of the bars such that water expelled from pulp fibres forced against the pulp side is received in the inlet openings and is conducted through the drainage conduits to the drainage side.

Preferably, each of the inlet openings has a diameter of approximately one-half of the average pulp fibre length of the pulp intended to be processed by the refiner apparatus and each of the inlet openings is spaced apart from an adjacent opening by a distance greater than the average pulp fibre length intended to be processed by the refiner apparatus.

Preferably, each of the drainage conduits has a length generally equal to the diameter of its corresponding inlet opening.

In accordance with another aspect of the invention, there is provided a method of refining pulp between facing refiner members of a pulp refiner in which at least one of the facing refiner members is movable relative to the other, the method including the step of draining water from pulp fibres squeezed between the facing refiner members, through at least one drainage conduit in at least one of the refiner members.

Preferably, the method includes the step of receiving water expelled from the pulp fibres squeezed between the facing refiner members, in a drainage opening disposed in a pulp side of the at least one of the refiner members the drainage opening being in communication with the at least one drainage conduit.

Also preferably, the method includes the step of conducting water received at the at least one drainage opening to a drainage area separated from the pulp side.

Further preferably, the method includes the step of dispersing water from the drainage area for collection at an exhaust port of the refiner.

Further preferably, the method includes the step of recombining refined pulp fibres with water collected at the exhaust port.

According to another aspect of the invention, there is provided a solution of refined pulp produced in accordance with the method above.

Effectively, the present invention drains water from the refining zone which creates a localized area of high consistency pulp solution therein. This allows low consistency pulp solution to be pumped into the refiner, allows the pulp to refined in a high consistency pulp solution and recombines the refined pulp so produced with the drained water to form a refined pulp in a low consistency solution which can be easily handled using conventional, non-specialized, low cost handling equipment. Thus, generally low-cost low consistency refining equipment and pulp handling technology can be used to produce a low consistency solution of refined pulp comparable in strength to that of high consistency refined pulp. Hence, pulp having increased strength can be economically produced.

BRIEF DESCRIPTION OF THE DRAWINGS

In drawings which illustrate embodiments of the invention.

DETAILED DESCRIPTION

Figure 1:
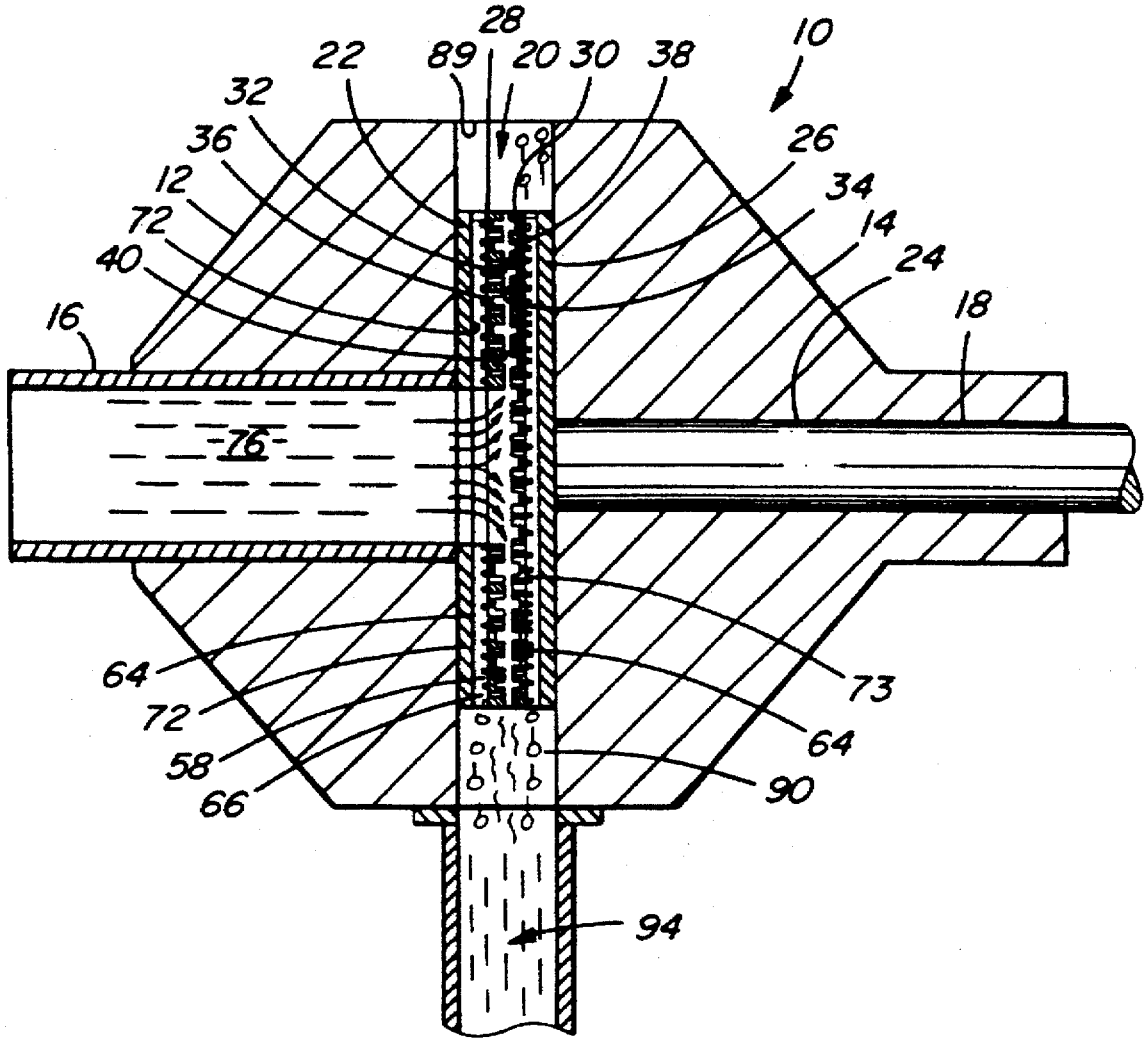
FIG. 1 is a cross-sectional view of an apparatus according to a first embodiment of the invention.

Referring to FIG. 1, a pulp refining apparatus according to a first embodiment of the invention is shown generally at 10. Generally, the pulp refining apparatus shown is similar to conventional low consistency pulp refiners, with the exception of the refiner plates which are a key aspect of the present invention as described below.

Conventional, prior art components of the pulp refining apparatus shown in FIG. 1 include first and second housing portions 12 and 14. The first housing portion 12 includes an inlet conduit 16 for receiving pulp having a consistency of approximately 2% to 4%. The second housing portion 14 has a shaft 18 driven in rotation by a motor (not shown). The first and second housing portions are connected together in such a manner that a generally circular disk-shaped area 20 is defined between the first and second housing portions 12 and 14.

Within the circular disk shaped area, the inlet conduit 16 is terminated in a first stationary mounting plate 22 secured to the first housing portion 12. Also within this space, an end portion 24 of the shaft 18 is connected to a second mounting plate 26 which rotates with the shaft 18.

Non-conventional first and second disk-shaped refiner plates 28 and 30 according to the first embodiment of the invention, are connected to the conventional first and second mounting plates 22 and 26 such that the first refiner plate 28 is stationary and the second refiner 30 plate is rotated with the second mounting plate 26. Thus, the first and second refiner plates 28 and 30 are moveable relative to each other.

The first and second refiner plates 28 and 30 each have respective pulp sides 32 and 34 and drainage sides 36 and 38 disposed on opposite sides of each refiner plate 28 and 30, thus the pulp sides 32 and 34 and drainage sides 36 and 38 are separated from each other by the plates 22 and 26 themselves. The pulp sides 32 and 34 of respective plates face each other and define a refining zone 40 therebetween. The drainage sides 36 and 38 of each refiner plate 28 and 30 face their respective mounting plates 22 and 26. Generally, the pulp sides 32 and 34 are operable to receive pulp therebetween and the drainage sides facilitate dispersement of water.

Figure 2:
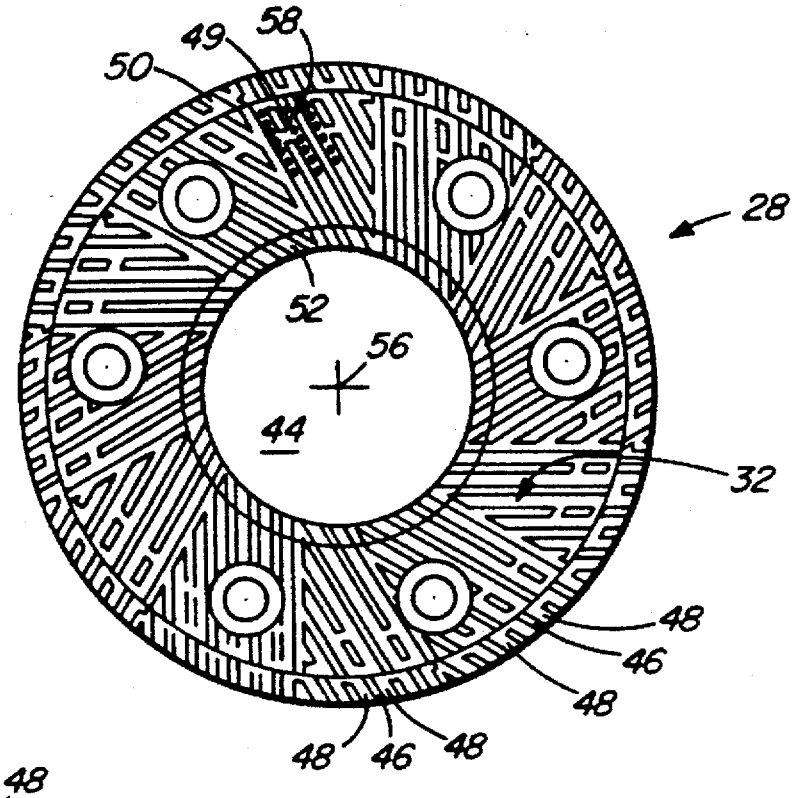
FIG. 2 is a plan view of a pulp side of a disk-shaped refiner plate according to the first embodiment.

Referring to FIG. 2, the first refiner plate is shown generally at 28 and has an annular disk-shape with a central relatively large circular opening 44 through which pulp may pass to enter the refining zone 40 shown in FIG. 1, when the apparatus is in use. The pulp side is shown generally at 32 and has a plurality of generally rectangular-parallelepiped shaped raised bar portions 46 formed therein. The bar portions 46 are spaced apart by respective rectangularly shaped valleys 48 having a width slightly larger than the width of the bar portions 46. In the embodiment shown, the width of the bar portions 46 is approximately 0.157 inches and the distance between centres of adjacent bar portions 46 is approximately 0.394 inches.

Figure 3:
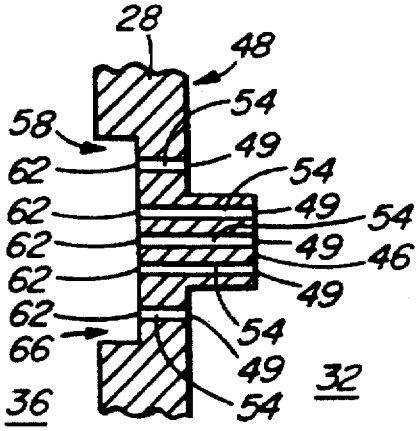
FIG. 3 is a fragmented, cross-sectional view of a bar portion and adjacent valley portions of the refiner plate shown in FIG. 2.

Generally, the entire pulp side 32 of the refiner plate 28 has a plurality of generally circular inlet openings 49 formed therein, with the exception of marginal portions 50 and 52 at the outer circumference of the plate 28 and surrounding the relatively large circular opening 44 respectively. The inlet openings 49 are located in the raised bar portions 46 and in the valleys 48 at an overall density of approximately 250–300 inlet openings per square inch. Referring to FIG. 3, the inlet openings 49 define associated respective drainage conduits 54 extending through the refiner plate 28, from the pulp side 32 to the drainage side 36, extending generally parallel to the axis 56 of the refiner plate 28 (the axis being shown in FIG. 2).

In this embodiment, the openings 49 and drainage conduits 54 each have a diameter of approximately 1mm. The diameter of the inlet openings 49 and drainage conduits 54 is desirably less than one-half of the average length of fibre intended to be refined by the apparatus as diameters greater than one-half the average length of the fibres tend to promote clogging of the openings 49 by the fibres. Diameters far less than one-half of the average fibre length will restrict the capacity to drain water from the fibres as will be described below. In this embodiment, the average length of fibres to be refined is approximately 2.4 mm. Generally, for most refining applications the average length of pulp fibre is between 1 mm and 4 mm and therefore the diameter of the inlet openings 49 may be between 0.5 and 2.0 mm.

Referring back to FIG. 2, to facilitate self-clearing of the drainage conduits 54, the drainage conduits 54 are arranged in clusters 57 of seven, including six drainage conduits 54 formed in a hexagonal shape about a central conduit. The distance between any two inlet openings of respective drainage conduits in each cluster is preferably no less than the average length of the fibres to be refined by the apparatus, to minimize bridging of fibres between adjacent inlet openings 49 and possible clogging of the openings.

Figure 4:
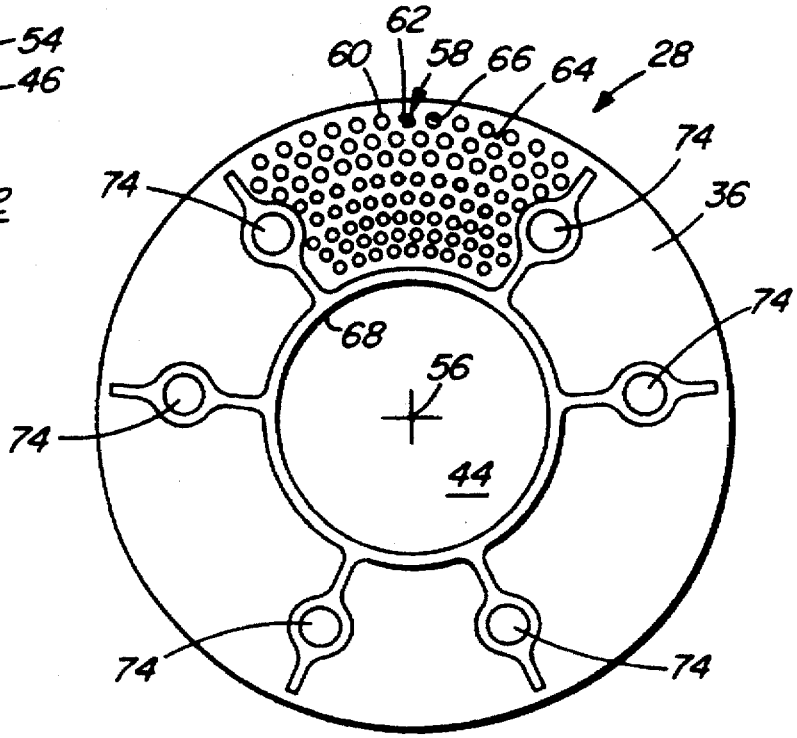
FIG. 4 is a bottom plan view of a drainage side of the refiner plate shown in FIG. 2.

Referring to FIGS. 3 and 4, to further facilitate self-clearing of the drainage conduits 54, a plurality of approximately 5 mm diameter collection conduits 58 are formed in the drainage side 36 of the refiner plate The drainage conduits are formed such that each cluster 57 of seven drainage conduits 54 terminates in a respective outlet opening 62, draining into an associated collection conduit 58. Hence, each collection conduit 58 is in communication with a plurality of outlet openings 62 and is operable to channel water from respective outlet openings 62 to the drainage side 36 of the refiner plate 28. The forming of the collection conduits 58 decreases the depths of the drainage conduits 54, to reduce clogging of the drainage conduits 54 by the pulp fibres, while still preserving the structural integrity of the refiner plate 28. In the embodiment shown, the collection conduits 58 are formed such that the depth of the drainage conduits having inlet openings 49 in the valleys 48 is approximately 1.5 mm. The bar portions 46, of course, will have drainage conduits 54 of greater depth, depending upon the amount by which they are raised from the valleys 48.

Referring to FIG. 4, the drainage side 36 has a drainage surface 64 in which is formed outlet openings 66 of respective collection conduits 58. Also formed in the drainage surface 64 is a generally annular wall portion 68 extending about the relatively large circular opening 44. From the annular wall portion there is a plurality of generally radially extending wall portions 70 extending therefrom, which act as a plurality of spacers for spacing the drainage surface 64 from a mounting surface 72 of the first mounting plate 22 shown in FIG. 1. Referring to FIG. 1, water flowing from the outlet openings 66 of the collection conduits 58 is operable to flow radially of the refiner plate 28, between the drainage surface 64 and the mounting surface 72. Referring back to FIG. 4, the radially extending wall portions 70 each have respective mounting openings 74 through which conventional fasteners (not shown) are inserted to secure the refiner plate 28 to the mounting plate 22, shown in FIG. 1.

Generally, the second refiner plate 30 is similar to the first plate 28 with the exception that the second plate has no central relatively large opening, but rather has a true disk shape. It does however, have bar portions, valleys and drainage conduits etc. like the first refiner plate 28.

Operation

Referring to FIG. 1, a conventional solution of low consistency pulp solution 76 is pumped through the inlet conduit 16 and into the refining zone 40, using conventional, low cost pump technology (not shown).

Referring to FIG. 5, sub-figures a–e depict activity occurring in the refining zone 40 shown in FIG. 1. Each sub-figure shows left-hand and right-hand bar portions 78 and 80, the left-hand bar portions 78 being associated with the first refiner plate 28 and the right-hand bar portions 80 being associated with the second refiner plate 30. In each sub-figure case the left-hand bar portions 78 are stationary while the right-hand bar portions 78 are moving upwardly, in the direction indicated by the arrow 82.

Figures 5A, 5B, 5C, 5D, 5E:
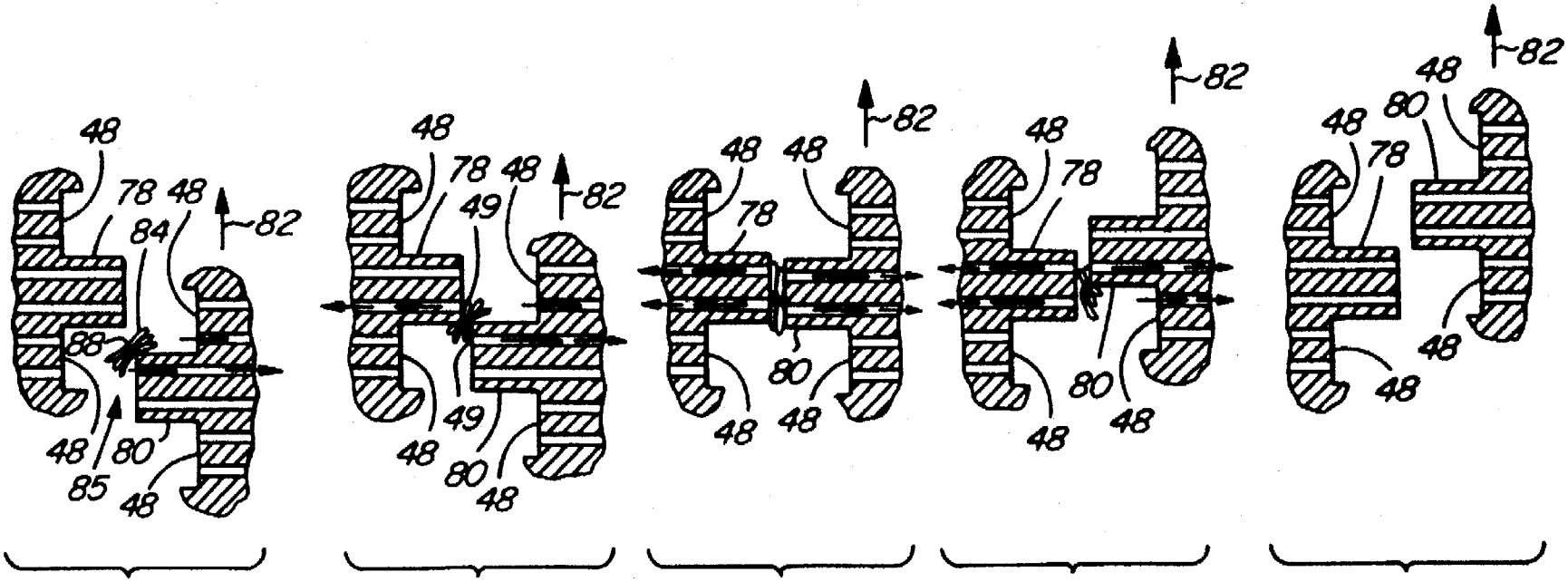
FIG. 5 is a schematic diagram illustrating a plurality of steps involved in a method of refining pulp, according to the invention.

Referring to FIG. 5*a*, pulp fibres 84 are gathered in wads 85 on a leading edge 88 of the moving bar portion 80 as it moves in the refining zone 40. As the pulp fibres 84 are gathered by the leading edge 88, impact of the bar portion 80 with the pulp fibres 84 causes preliminary, localized dewatering of the pulp fibres 84. At least some of this water drains through inlet openings 49 in the valleys 48 between the bar portions 78 and 80.

Referring to FIG. 5*b*, as the right-hand bar portions 78 approach the left-hand bar portions 78, mechanical pressure is exerted on the pulp fibres 84 causing them to further expel water, which drains into the inlet openings 49 in the valleys 48 and in the bar portions 78 and 80.

Referring to FIG. 5*c*, as the bar portions pass each other, the pulp fibres 84 are fully compressed and any water in the area between adjacent faces of the bar portions is forced through the inlet openings 49. Hence, water is drained from pulp fibres 84 squeezed between facing refiner bar portions, through at least one drainage conduit 54 in at least one of the refiner bar portions 78 and 80. The pulp fibres 84 slide under pressure between opposing faces of the bar portions 78 and 80 however, the fibres generally do not enter the inlet openings 49 as they are generally longer than the diameter of the inlet openings 49 and are oriented diametrically across the inlet openings 49.

Referring to FIG. 5*d*, as the right-hand bar portion 80 moves past the left-hand bar portion 78, the mechanical pressure on the pulp fibres 84 is released.

FIG. 5*e* illustrates dispersion of the refined pulp fibres 84 after the right-hand bar portion has past the left hand bar portion 78.

Referring back to FIG. 1, generally, the drainage of water from the refining zone 40 via the drainage conduits 54 reduces the ratio of water to pulp fibre 84 in that area, effectively increasing the consistency of the pulp solution in the refining zone 40. Hence, the pulp solution is of localized high consistency in the refining zone 40 and the benefits of high consistency refining are realized. Such benefits include good beating response due to increased fibre-to-fibre contact and less cutting action.

Water flowing into the inlet openings 49 during the above process drains through the drainage conduits 54 in the bar portions 78 and 80 and in the valleys 48, into respective collection conduits 58 and to the drainage sides 36 and 38 of the plates 28 and 30, between the drainage surfaces 64 and the associated mounting surfaces 72 and 73. With the first refiner plate 28, which is stationary, the water simply drains radially downwardly by gravity into an exhaust port 86 of the apparatus. With the second refiner plate 30, water from the collection conduits 58 flows radially outwardly, between the drainage surface 64 and the mounting surface 73 and strikes the annular housing 89 where it runs downwardly under the influence of gravity and collects at the exhaust port 86 of the apparatus. Eventually, the refined fibres 90 also reach the exhaust port 86 where they recombine with water 92 expelled earlier in the process, generally re-forming a low consistency solution of pulp 94 which is easy to handle using conventional, low cost pumping equipment methods.

In general, low consistency pulp solution is fed into the apparatus and low consistency, refined pulp solution is produced by the apparatus, however, inside the apparatus, in the refining zone 40, water is drained from the pulp solution making it a locally high consistency solution and therefore, the pulp is refined as a high consistency solution and enjoys the attendant benefits of high consistency refining. Since the pulp fed into the apparatus and the refined pulp produced by the apparatus is of low consistency, conventional low consistency pulp handing technology may be employed outside of the apparatus. This reduces the cost of producing high consistency refined pulp. By employing the present invention low consistency equipment may be used with the plates described in connection with FIGS. 1–4 to achieve generally the same results as attainable with high consistency refining equipment.

While specific embodiments of the invention have been described and illustrated, such embodiments should be considered illustrative of the invention only and not as limiting the invention as construed in accordance with the accompanying claims.

What is claimed is:

1. A refiner apparatus for exerting mechanical forces on pulp fibers, the apparatus comprising:

a) a member having a pulp side and a drainage side, said pulp side having a plurality of spaced apart raised bar portions thereon; and b) a plurality of drainage conduits formed in said member, said conduits extending between said pulp side and said drainage side of said member, each drainage conduit having inlet and outlet openings respectively, said inlet openings being disposed on said pulp side of said member and said outlet openings being disposed on said drainage side of said member said inlet openings being dimensioned such that fibers generally do not enter said inlet openings and such that water expelled from pulp fibers forced against said pulp side is received in said inlet openings and is conducted through said drainage conduits to said drainage side of said member.

2. An apparatus as claimed in claim 1 wherein each of said inlet openings is circular in shape and has a diameter of between 0.5 and 2.0 millimeters.

3. An apparatus as claimed in claim 2 wherein each of said inlet openings has a diameter of approximately one-half of the average pulp fibre length of the pulp intended to be processed by said refiner apparatus.

4. An apparatus as claimed in claim 3 wherein each of said inlet openings is spaced apart from an adjacent opening by a distance greater than the average pulp fibre length intended to be processed by said refiner apparatus.

5. An apparatus as claimed in claim 3 wherein each of said drainage conduits has a length generally equal to the diameter of its corresponding inlet opening.

6. An apparatus as claimed in claim 1 including approximately 250–300 inlet openings per square inch.

7. An apparatus as claimed in claim 1 wherein said member includes a generally disk-shaped plate operable to be rotated in a disk refiner, said drainage side being separated from said pulp side by said plate.

8. An apparatus as claimed in claim 7 wherein said disk-shaped plate has a drainage surface on said drainage side and a plurality of spacers for spacing said drainage surface from a mounting surface associated with the disk refiner such that water flowing from said outlet openings is operable to flow radially of said disk-shaped plate, between said drainage surface and said mounting surface for collection at an exhaust port of the disk refiner.

9. An apparatus as claimed in claim 8 wherein said spacers include a plurality of generally radially extending wall portions projecting from and disposed on said drainage surface, said radially extending wall portions being operable to direct water to flow radially outwardly from said outlet openings when said disk-shaped plate is rotated.

10. An apparatus as claimed in claim 9 wherein said plate has a plurality of collection conduits, each of said collection conduits being in communication with a plurality of outlet openings and being operable to channel water from respective outlet openings of said drainage conduits to said drainage side of said disk-shaped plate.

11. An apparatus as claimed in claim 10 wherein approximately 7 outlet openings are in communication with one respective collection conduit.

12. An apparatus for refining pulp, the apparatus including first and second sets of facing refiner bars having opposing pulp sides, at least one of said sets being moveable relative to the other, and the first and second sets being positioned relative to each other such that mechanical pressure is applied to pulp fibers between opposing pulp sides of said refiner bars when said at least one of said sets is rotated, at least one of said sets of refiner bars having a drainage side separated from said pulp face side and having a plurality of drainage conduits having inlet openings in said pulp side, said inlet openings being dimensioned to drain water from pulp fibers between said opposing face sides of said refiner bars while generally preventing said pulp fibers from entering said inlet openings.

13. An apparatus as claimed in claim 12 wherein each of said drainage conduits has inlet and outlet openings respectively, said inlet openings being disposed on said pulp face sides of the bars of said at least one of said sets and said outlet openings being disposed on said drainage sides of said bars of said at least one of said sets such that water expelled from pulp fibres forced against said pulp side is received in said inlet openings and is conducted through said drainage conduits to said drainage side of said at least one of said sets.

14. An apparatus as claimed in claim 13 wherein each of said inlet openings is circular in shape and has a diameter of between 0.5 and 2.0 millimeters.

15. An apparatus as claimed in claim 14 wherein each of said inlet openings has a diameter of approximately one-half of the average pulp fibre length of the pulp intended to be processed by said refiner apparatus.

16. An apparatus as claimed in claim 15 wherein each of said inlet openings is spaced apart from an adjacent opening by a distance greater than the average pulp fibre length intended to be processed by said refiner apparatus.

17. An apparatus as claimed in claim 15 wherein each of said drainage conduits has a length generally equal to the diameter of its corresponding inlet opening.

18. An apparatus as claimed in claim 13 including approximately 250–300 inlet openings per square inch.

19. An apparatus as claimed in claim 13 further including a generally disk-shaped plate operable to be rotated in a disk refiner, at least one of said sets of refiner bars being disposed on said disk-shaped plate, said drainage side being separated from said pulp side by said plate.

20. An apparatus as claimed in claim 19 wherein said disk-shaped plate has a drainage surface on said drainage side and a plurality of spacers for spacing said drainage surface from a mounting surface associated with the disk refiner such that water flowing from said outlet openings is operable to flow radially of said disk-shaped plate, between said drainage surface and said mounting surface for collection at an exhaust port of the disk refiner.

21. An apparatus as claimed in claim 20 wherein said spacers include a plurality of generally radially extending wall portions projecting from and disposed on said drainage surface, said radially extending wall portions being operable to direct water to flow radially outwardly from said outlet openings when said disk-shaped plate is rotated.

22. An apparatus as claimed in claim 21 wherein said plate has a plurality of collection conduits, each of said collection conduits being in communication with a plurality of outlet openings and being operable to channel water from respective outlet openings of said drainage conduits to said drainage side of said disk-shaped plate.

23. An apparatus as claimed in claim 22 wherein approximately 7 outlet openings are in communication with one respective collection conduit.

24. A method of refining pulp between facing refiner members of a pulp refiner in which at least one of said facing refiner members is movable relative to the other, the method including the step of:

a) draining water from pulp fibers squeezed between said facing refiner members, through at least one drainage conduit in at least one of said refiner members by generally preventing the entry of said pulp fibers into said at least one drainage conduit while generally permitting the entry of water into said at least one drainage conduit.

25. A method as claimed in claim 24 further including the step of receiving water expelled from said pulp fibres squeezed between said facing refiner members, in a drainage opening disposed in a pulp side of said at least one of said refiner members said drainage opening being in communication with said at least one drainage conduit.

26. A method as claimed in claim 25 further including the step of conducting water received at said at least one drainage opening to a drainage area separated from said pulp side.

27. A method as claimed in claim 26 further including the step of dispersing water from said drainage area for collection at an exhaust port of said refiner.

28. A method as claimed in claim 27 further including the step of recombining refined pulp fibres with water collected at said exhaust port.

* * * * *